US005248023A

United States Patent [19]

Vidondo

[11] Patent Number: 5,248,023

[45] Date of Patent: Sep. 28, 1993

[54] COIN SELECTORS

[75] Inventor: Guindulain Vidondo, Peralta, Spain

[73] Assignee: Jofemar, S.A., Peralta, Spain

[21] Appl. No.: 730,239

[22] Filed: Jul. 15, 1991

[30] Foreign Application Priority Data

Jul. 17, 1990 [ES] Spain ..... 9001938

[51] Int. Cl.[5] ..... G07D 5/04

[52] U.S. Cl. ..... 194/317; 194/339

[58] Field of Search ..... 194/317, 318, 339, 340, 194/341

[56] References Cited

U.S. PATENT DOCUMENTS 4,327,824 5/1982 Nicholson ..... 194/339 X 4,437,478 3/1984 Abe ..... 194/318 X

*Primary Examiner*—F. J. Bartuska

*Attorney, Agent, or Firm*—Darby & Darby

[57] ABSTRACT

Improvements in coin selectors to determine weight as an additional measurement to the alloy, diameter and cross section consisting of a mechanical device made up of two overlapped levers (2) and (3) the free end of lever (2) remaining under an orthogonal projection (6) of lever (3), lever (3) being in connection with a ferrite (7) in whose magnetic field it penetrates, upon the coin being located in area A of lever (2). It has an electronic device made up of an oscillator (8) of ferrite (7) with a rectifier (15) to determine the wave amplitude of the oscillator, as well as an analogic-digital converter (16) which transforms the analogic value provided by the rectifier into a number that the C.P.U. (17) processes. On the other hand, the Schmitt scale (18) transforms the sinewave into rectangular impulses, passing over a bridge (19), the C.P.U. determines the period and processes this information, obtaining the weight of the coin.

3 Claims, 3 Drawing Sheets

COIN SELECTORS

OBJECT OF THE INVENTION

The following invention, as is expressed in the title of the present specification, consists of some improvements in coin selectors based on determining the weight of the coin, which permit greater precision in acceptance of coins, rejecting all objects or coins that do not correspond exactly with some of the coins for which the selector is programmed to recognize.

Thus, the selector is provided with a levers mechanism, one of them remaining in correspondence with a ferrite in such a way that upon the object to be recognized rolling over them its weight causes a different penetration of the ferromagnetic element (lever) within the magnetic field of the oscillator, according to the different weights of the object to be recognized. This penetration of the ferromagnetic element within the field of the ferrite, causes a modification of the amplitude and frequency of the oscillator of the ferrite, in such a way that measuring this amplitude and frequency establishes a relation between the obtained values and the weight of the coin.

BACKGROUND OF THE INVENTION

Among known coin selectors, we can cite those that are provided with three magnetic sectors to determine the cross section, diameter and alloy of coins, in such a way that said magnetic sensors are located in the channel where the coins to be recognized by the selector pass, the reading being done upon the different coins passing in front of them.

The applicant of the present registration is owner of utility model no. 285.961, which claims some improvements consisting of effecting the reading of some of the parameters and subsequently effecting the reading of the other two parameters in terms of the first reading effected.

Thus, first of all the reading of the diameter will be done and then that of the cross section and alloy or vice versa, whereby there is greater reliability in the recognition of the coins inserted in the selector for the validation thereof.

Likewise, the applicant is also owner of utility model U8902302 which presents the incorporation of a pair of position detectors of the coins in the coin selectors, in such a way that they permit each one of the magnetic sensors for the measuring of the alloy, diameter and cross section of coins, to effect the reading always in connection with the same relative position of the coin to be validated or recognized. Said pair of position detectors remains inserted between the three magnetic sensors obtaining that the relative position of the coins to be validated with regard to each one of the magnetic sensors when the reading is done is the same.

DESCRIPTION OF THE INVENTION

The improvements in the coin selectors that are described in the present specification are based on the determination of the weight of the coin to be recognized, basically based on producing interference in the magnetic field of an oscillator that will depend on the weight of the coin to be recognized, in such a way that by measuring this interference we determine a relation between the state of the oscillator and the weight of the coin, said state being defined by the amplitude and frequency.

Thus, it consists of a mechanical device and another electronic one. The mechanical device is formed by a combination of a pair of levers in such a way that the tilting that is produced in one of them by the weight of the coin to be recognized will cause a tilting in the second lever (ferromagnetic element), which penetrates in the magnetic field of the oscillator.

The electronic device has an oscillator of a ferrite, which the lever that tilts by effect of the lever on which the coin to be recognized rests faces, of a rectifier and corresponding filtrate to determine the wave amplitude of the oscillator, an analogic digital converter which transforms the analogic value that the rectifier provides into a number that the C.P.U. processes and besides it has a Schmitt scale that transforms the sinewave into rectangular impulses and in this way by means of the bridge, the C.P.U. determines the period of the wave of the oscillator.

Likewise, near the inlet of the selector there is a small lever whose free end remains in correspondence with a diode whose beam of light interferes, in such a way that once the coin has entered into the selector, although it is validated it is not received and accounted for until said lever returns to its inoperative position and the beam is again interfered with, thus avoiding the inserted coin from being accounted for although it is tied to a string and subsequently removed without having been received by the selector.

In order to complement the description that is going to be made hereinafter and for the purpose of providing a better understanding of its features, the present specification is accompanied by a set of drawings in whose figures the most significant details of the invention are represented in an illustrative and non-restrictive manner.

DESCRIPTION OF A PREFERRED EMBODIMENT

Figure 1:
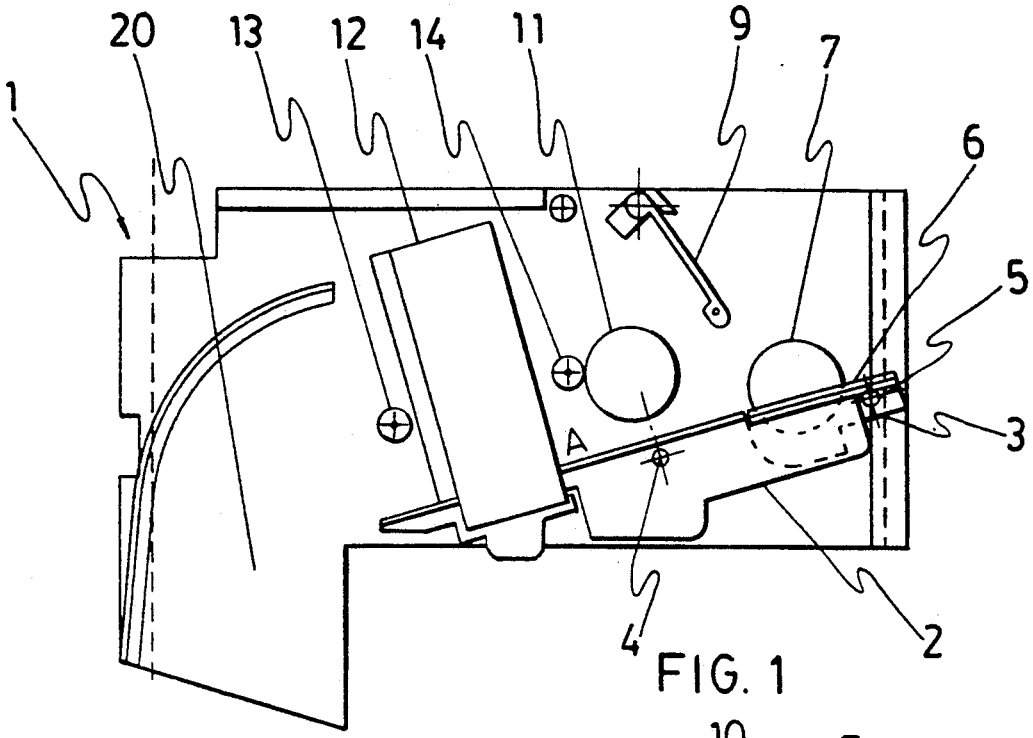
FIG. 1—It shows a view of the selector according to the front area where the coins pass, showing the pair of levers of the mechanical device, as well as the ferrite in whose mechanical field one of the ferromagnetic elements (levers) penetrates and the lever close to the inlet of the coins whose free end interferes with the beam emitted by the diode.
Figure 2:
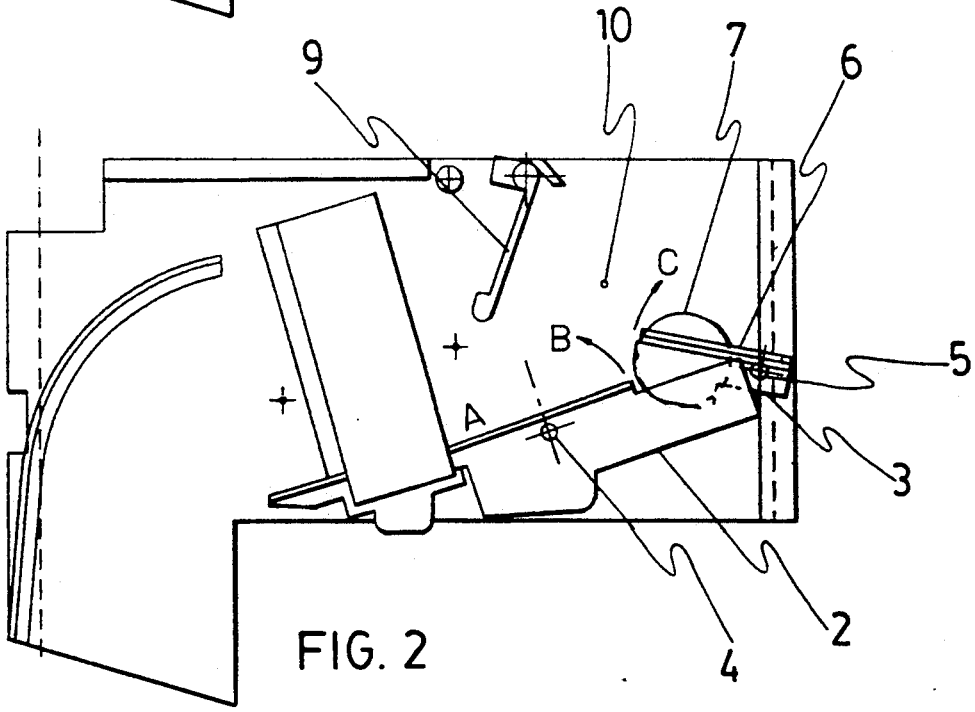
FIG. 2—It shows a view of the selector according to the view of the above figure, both levers being turned, as well as the lever close to the inlet base of the selector.
Figure 3:
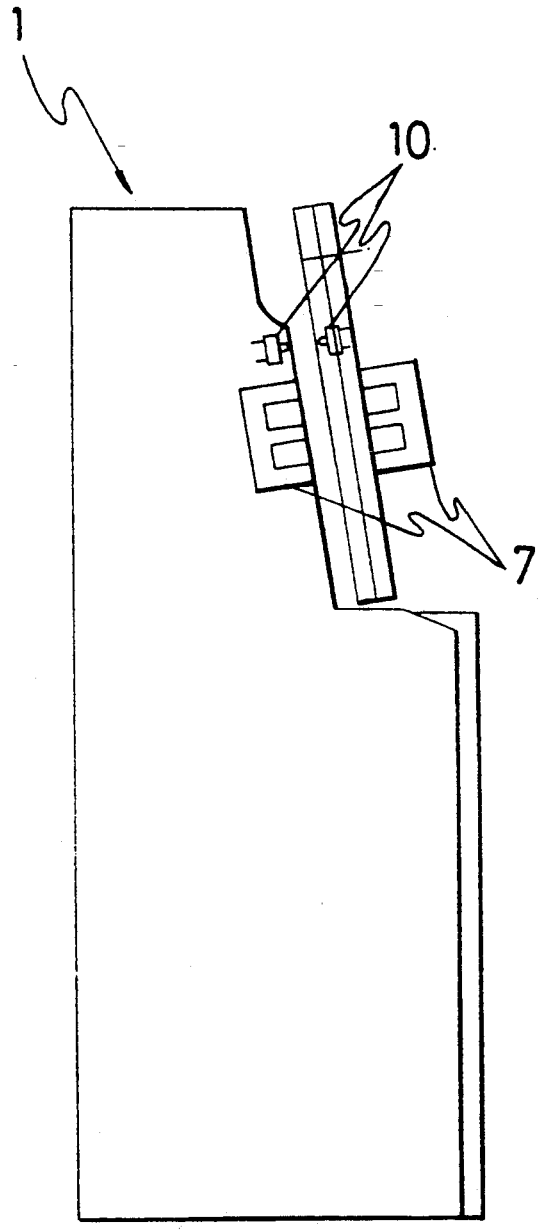
FIG. 3—It shows a raised side view of the selector in which one observes the emitter and the detector of the beam of light of the diode, between which there is the free end of the lever close to the inlet of the selector, interferring with said beam and the ferrite in whose magnetic field the ferromagnetic element penetrates.
Figure 4:
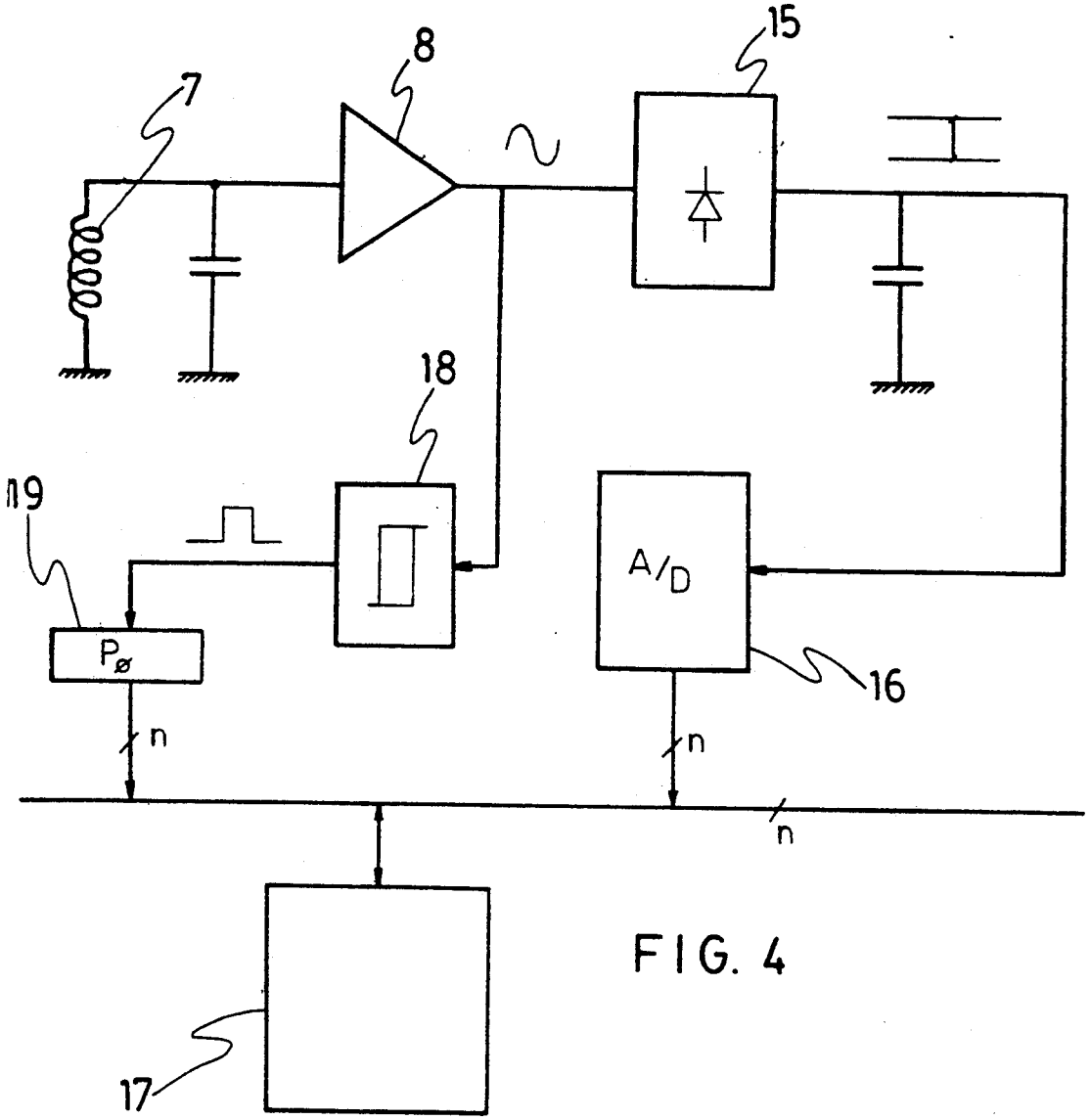
FIG. 4—It shows a view of the electronic diagram to determine the weight of the coin in combination with the mechanical levers device.

In view of the cited figures and in accordance with the numbering used, we can see how the selector (1) is provided with a pair of levers (2) and (3) that form the mechanical device, which are rotatable with regard to shafts (4) and (5) respectively. Both levers (2) and (3) remain overlapped in such a way that the lever (3) has in its top part an orthogonal projection (6) upon which the free end of the lever (2) rests in the inoperative position.

When the coin to be recognized has been inserted, it rolls over the lever (2) reaching side A of the spin axis (4) of the same, in such a way that its weight causes it to tilt in the direction of the arrow B, and thus the tilting of the lever or ferromagnetic element (3) is produced in the direction of arrow C, upon the free end of the lever (2) coming up against the projection (6) of the lever (3), causing the latter to penetrate into the magnetic field of the ferrite, producing a modification of the amplitude and frequency of the oscillator (8) of the ferrite.

Lever (9) remains situated near the inlet of the coins and its free end remains inserted between the emitter and detector of the beam of light of diode (10), in such a way that once the coin penetrates it displaces it, producing the interruption of the cutting off of the beam of light and until this beam is again interrupted there is no accounting for and acceptance of the recognized coin, which passes to the inside through duct (20). Thus, it is avoided in those cases in which the coin is tied to a string, that said coin can be removed once it has been accounted for by the selector, since the string prevents lever (9) from returning to its inoperative position and the beam of light is interrupted again, at which time the coin is not accounted for and accepted.

The selector is provided with a ferrite (11) and the hollow coil (12) to detect the composition of the material of the coin to be recognized, based on the Foucault current and diodes (13) and (14) permit the reading of sensors (12) and (11) to be done in the same position of the coin with regard to the same.

Given that there are coins which have identical physical dimensions (diameter and thickness, in other words, volume), and a composition of a different material, giving the same measurement based on Foucault current, errors are produced in the validation of coins, in such a way that by means of an additional device which permits weighing the same, the recognition thereof is made easier and thus errors are avoided, since as the coins are made out of different materials, their densities will be different and therefore their weights.

Thus, the present specification describes a device which makes it possible to determine the weight of the coins by means of a mechanical and electronic combination.

The electronic device has an oscillator (8) of the ferrite (7), a rectifier (15), with the corresponding filtrate, to determine the wave amplitude of the oscillator, an analogic-digital converter (16) that transforms the analogic value that the rectifier (15) provides into a number that the C.P.U. (17) processes and besides it has a Schmitt scale that transforms the sinewave into rectangular impulses and in this way by means of the bridge (19), the C.P.U. determines the period of the wave of the oscillator (8.)

The weight of the coins modifies the amplitude and the period due to the fact that with different weights, by means of the mechanism of levers (2) and (3), we have different penetrations of the ferromagnetic element (3), within the magnetic field of the oscilaltor (8.) By means of the rectifier (15) and the analogic-digital converter (16), the C.P.U. (17) receives the information of the amplitude and by means of the Schmitt scale (18) and the bridge (19), information of the period is received. The C.P.U. (17) processes this information and determines the weight of the coin, comparing it with a reference table of weights of the coins programmed for their recognition and it determines whether or not the weight coincides with any of them.

In the described manner, aside from knowing the volume and alloy of the coins to be recognized, we determine the weight thereof giving the selector great reliability in recognition of the coins.

Thus, lever (9) detects at all times whether in the channel where the coins pass there is a string which has been tied to a coin.

I claim:

1. A selection device for use in a coin selector for determining the weight of coins placed into said coin selector, said selection device comprising:

two levers, said levers at least partially overlapping each other and being interconnected such that movement of one of said levers will cause proportional movement of the other of said levers, the other of said levers being formed of a ferromagnetic material;

a ferrite positioned within said selection device such that movement of said one of said levers will cause the said other of said levers to move within the magnetic field of said ferrite, the movement of said one of said levers being caused by the weight of a coin placed into said selection device; and means for determining the weight of said coin from the position of said other of said levers with respect to said ferrite.

2. A selection device as in claim 1 wherein said means for determining comprises a selection circuit, said selection circuit having an oscillator including said ferrite, said oscillator having a frequency depending on the position of said other of said levers with respect to said ferrite, said selection circuit also having a central processing unit, said central processing unit determining the weight of a coin placed in said selection device based on the corresponding frequency of said oscillator.

3. A selection device as in claim 2 further comprising an inlet for receiving said coins and a third lever adjacent said inlet, said third lever preventing removal of a coin from said selection device through said inlet.

* * * * *